US009701037B2

(12) United States Patent
Zieger et al.

(10) Patent No.: US 9,701,037 B2
(45) Date of Patent: Jul. 11, 2017

(54) TOOL COUPLING DEVICE

(71) Applicant: Robert Bosch GmbH, Stuttgart (DE)

(72) Inventors: Jens Zieger, Altbach (DE); Uwe Engelfried, Ostfildern (DE); Petr Grulich, Kirchheim/Teck (DE); Thomas Duerr, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 187 days.

(21) Appl. No.: 14/409,040

(22) PCT Filed: May 14, 2013

(86) PCT No.: PCT/EP2013/059930

§ 371 (c)(1),
(2) Date: Dec. 18, 2014

(87) PCT Pub. No.: WO2014/000950

PCT Pub. Date: Jan. 3, 2014

(65) Prior Publication Data

US 2015/0290830 A1 Oct. 15, 2015

(30) Foreign Application Priority Data

Jun. 28, 2012 (DE) ..... 10 2012 211 096

(51) Int. Cl.
*B27B 17/14* (2006.01)
*B27B 17/02* (2006.01)

(52) U.S. Cl.
CPC ..... *B27B 17/14* (2013.01); *B27B 17/02* (2013.01)

(58) Field of Classification Search
CPC ..... B27B 17/02; B27B 17/14
(Continued)

(56) References Cited

U.S. PATENT DOCUMENTS 3,267,973 A * 8/1966 Beard ..... B27B 17/14 30/386
4,316,327 A * 2/1982 Scott ..... B27B 17/14 30/386

(Continued)

FOREIGN PATENT DOCUMENTS

CN 1622871 A 6/2005
CN 2715900 Y 8/2005

(Continued)

OTHER PUBLICATIONS

International Search Report corresponding to PCT Application No. PCT/EP2013/059930, mailed Sep. 5, 2013 (German and English language document) (5 pages).

*Primary Examiner* — Hwei C Payer
(74) *Attorney, Agent, or Firm* — Maginot, Moore & Beck LLP

(57) ABSTRACT

A tool coupling device is configured to hold a machine tool cutting device. In particular, the tool coupling device is configured to hold a machine tool cutting device configured as a closed system, having at least one cutting train clamping unit for generating a cutting train clamping force and having at least one tool-holding unit comprising at least one movably mounted tool-holder element. The tool coupling device includes at least one movement-coupling unit by which the tool-holder element can be coupled with a clamping element for a movement of the clamping element of the cutting train clamping unit.

3 Claims, 11 Drawing Sheets

(58) Field of Classification Search
USPC ..... 30/386
See application file for complete search history.

(56) References Cited

U.S. PATENT DOCUMENTS

| | | | | |
|---|---|---|---|---|
| 6,237,228 | B1 * | 5/2001 | Moody | B27B 17/14 30/381 |
| 6,560,879 | B2 * | 5/2003 | Franke | B27B 17/14 30/383 |
| 6,694,623 | B1 | 2/2004 | Haughey | |
| 7,107,689 | B2 * | 9/2006 | Keeton | B27B 17/14 30/383 |
| 7,743,513 | B1 | 6/2010 | Fisher et al. | |
| 9,132,568 | B2 * | 9/2015 | Peterson | B27B 17/14 |
| 2010/0088905 | A1 * | 4/2010 | Pellenc | B27B 17/14 30/386 |
| 2011/0314682 | A1 * | 12/2011 | Maag | B27B 17/14 30/386 |
| 2014/0150271 | A1 * | 6/2014 | Yamaoka | B27B 17/14 30/386 |
| 2015/0158199 | A1 * | 6/2015 | Engelfried | B27B 17/02 30/383 |
| 2015/0290830 | A1 * | 10/2015 | Zieger | B27B 17/02 30/383 |

FOREIGN PATENT DOCUMENTS

| | | | |
|---|---|---|---|
| CN | 1756631 | A | 4/2006 |
| EP | 2 036 688 | A2 | 3/2009 |
| WO | 2010/105809 | A1 | 9/2010 |

* cited by examiner

TOOL COUPLING DEVICE

This application is a 35 U.S.C. §371 National Stage Application of PCT/EP2013/059930, filed on May 14, 2013, which claims the benefit of priority to Serial No. DE 10 2012 211 096.8, filed on Jun. 28, 2012 in Germany, the disclosures of which are incorporated herein by reference in their entirety.

BACKGROUND

There are already known tool coupling devices for receiving a power-tool parting device realized as a closed system, which have a cutting-strand tensioning unit for generating a cutting-strand tensioning force, and which have a tool holding unit that comprises a movably mounted tool holding element.

SUMMARY

The disclosure is based on a tool coupling device for receiving a power-tool parting device, in particular a power-tool parting device realized as a closed system, having at least one cutting-strand tensioning unit for generating a cutting-strand tensioning force, and having at least one tool holding unit that comprises at least one movably mounted tool holding element.

It is proposed that the tool coupling device comprise at least one movement coupling unit, by means of which, for the purpose of moving a tensioning element of the cutting-strand tensioning unit, the tool holding element can be coupled to the tensioning element. The tensioning element is thus preferably connected to the tool holding element in a motionally dependent manner, via the movement coupling unit, in at least one movement direction. The tool coupling device is preferably provided to receive the power-tool parting device in a form-closed and/or force-closed manner, or to fix the power-tool parting device to a main body of the tool coupling device by means of a form-closed and/or by means of a force-closed connection, by means of the tool holding unit. "Provided" is to be understood to mean, in particular, specially programmed, designed and/or equipped. For the purpose of fixing the power-tool parting device to the main body, the tool holding element preferably exerts a clamping force upon a guide unit of the power-tool parting device, in the direction of the main body. Preferably, for the purpose of transmitting drive forces to the power-tool parting device, the power-tool parting device is received by the tool coupling device, or fixed to the main body of the tool coupling device. The tool holding element in this case preferably exerts a holding force upon the power-tool parting device, at least in one state, in particular in at least one state in which the power-tool parting device is connected to the tool coupling device. The tool holding element preferably fixes the power-tool parting device to the main body of the tool coupling device by means of a form-closed and/or by means of a force-closed connection. Particularly preferably, the tool holding element is provided to generate a holding force in at least one tool fixing position of the tool holding element. Moreover, the tool holding element is provided to actuate the cutting-strand tensioning unit by means of the movement coupling unit.

Preferably, the tool holding element is mounted such that it can be swiveled about an axis of motion of the tool holding element that is at least substantially parallel to a plane of main extent of the tool holding element. "Substantially parallel" is to be understood here to mean, in particular, an alignment of a direction relative to a reference direction, in particular in one plane, the direction deviating from the reference direction by, in particular, less than 8°, advantageously less than 5°, and particularly advantageously less than 2°. The term "plane of main extent" is intended here to define, in particular, a plane in which the tool holding element has a maximum extent. Preferably in this case, the tool holding element can be swiveled by a swivel angle that, in particular, is greater than 5°, preferably greater than 45°, and particularly preferably greater than 75°. Preferably, the plane of main extent of the tool holding element, in a tool holding element swiveled fully into an open position, is at least substantially parallel to a rotation axis of a drive element that is mounted in a rotatable manner in the main body of the tool coupling device. Preferably in this case, the axis of motion of the tool holding element is at least substantially perpendicular to a rotation axis of the drive element of the tool coupling device, or of a portable power tool comprising the tool coupling device, that is mounted in a rotatable manner in the main body of the tool coupling device. The expression "substantially perpendicular" is intended here to define, in particular, an alignment of a direction relative to a reference direction, wherein the direction and the relative direction, in particular as viewed in one plane, enclose an angle of 90° and the angle has a maximum deviation of, in particular, less than 8°, advantageously less than 5°, and particularly advantageously less than 2°. In an alternative configuration of the tool coupling device according to the disclosure, the tool holding element is preferably mounted such that it can rotate about an axis of motion of the tool holding element that is at least substantially perpendicular to a plane of main extent of the tool holding element. Preferably, the plane of main extent of the tool holding element extends at least substantially perpendicularly in relation to the rotation axis of the drive element.

The term "cutting-strand tensioning unit" is intended here to define, in particular, a unit provided to exert a tensioning force upon the cutting strand, for the purpose of tensioning, or pretensioning, a cutting strand of the power-tool parting device, at least in a state in which the power-tool parting device has been connected to the tool coupling device. The tensioning element in this case is preferably mounted on the main body of the tool coupling device so as to be movable relative to the main body of the tool coupling device. Particularly preferably, the tensioning element is mounted in a translationally movable manner. The expression "mounted in a translationally movable manner" is intended here to define, in particular, a mounting of a unit and/or of an element relative to at least one other unit and/or one other element, the unit and/or the element, in particular dissociated from an elastic deformation of the unit and/or element, and dissociated from movement capabilities caused by a bearing clearance, having a capability to move along at least one axis, along a travel distance greater than 1 mm, preferably greater than 5 mm, and particularly preferably greater than 10 mm. Advantageously, the configuration according to the disclosure makes it possible to achieve a tool coupling device that is easy to operate. Advantageously, by means of the cutting-strand tensioning unit, an automatic tensioning operation can be realized by actuation of the tool holding element. It is thus possible, advantageously, to achieve a holding force for fixing a power-tool parting device to the main body of the tool coupling device and, at the same time, tensioning of the cutting strand of the power-tool parting device fixed to the tool coupling device.

Furthermore, it is proposed that the movement coupling unit have at least one gate element for moving the tensioning element as a result of a movement of the tool holding element. A "gate element" is to be understood here to mean, in particular, an element having at least one recess, in particular a slot, in which there engages a further element that corresponds to the element, and/or which has at least one extension that engages in a recess of a further element that corresponds to the element, a constrained movement of the further element being effected, in dependence on a geometric shape of the recess, as a result of a movement of the element. Preferably, the gate element is realized as a gate disk or as a gate translation element. Preferably, the tensioning element engages in the recess of the gate element. Preferably, the movement coupling unit has at least one spring element, which is provided to apply a spring force to the tensioning element and/or to the gate element. A "spring element" is to be understood to mean, in particular, a macroscopic element having at least two ends that are spaced apart from each other and that, in a normal tool holding state, can be moved elastically relative to each other along a movement distance, the movement distance being at least greater than 0.5 mm, in particular greater than 1 mm, preferably greater than 2 mm, and particularly advantageously greater than 3 mm, and that, in particular, generates a counter-force, which is dependent on an elastic movement of the ends relative to each other and preferably proportional to the elastic movement of the ends relative to each other, and which counteracts the variation. A "macroscopic element" is to be understood to mean, in particular, an element having an extent of at least 1 mm, in particular of at least 5 mm, and preferably of at least 10 mm. The spring element in this case may be realized as a tension spring, as a compression spring, as a torsion spring, as a spiral spring, etc. Particularly preferably, the spring element is realized as a helical compression spring or as a leg spring. It is also conceivable, however, for the spring element to be of different configuration, considered appropriate by persons skilled in the art. The configuration of the tool coupling device according to the disclosure makes it possible, by simple configuration means, to achieve movement of the tensioning element in dependence on a movement of the tool holding element. Moreover, advantageously, the tensioning element can be biased to at least one tool holding position, in particular to a tensioning position, by means of the spring element.

Furthermore, it is proposed that the gate element be mounted in a translationally movable manner. Preferably, the gate element has an axis of motion that is at least substantially perpendicular to the rotation axis of the drive element. Preferably, the gate element is guided translationally by two linear guide elements of the movement coupling unit that are at least substantially parallel to each other. Advantageously, the configuration of the tool coupling device according to the disclosure enables the gate element to be guided in a precise manner.

In addition, in an alternative configuration of the tool coupling device, it is proposed that the gate element be mounted in a rotatable manner. Preferably, the gate element has an axis of motion that is at least substantially parallel to the rotation axis of the drive element. Advantageously, it is possible to achieve a movement coupling unit configured to have a flat structure. Thus, advantageously, a compact tool coupling device can be achieved.

Furthermore, it is proposed that the movement coupling unit comprise at least one lever element, by means of which the tool holding element can be coupled to a gate element of the movement coupling unit for the purpose of moving the tensioning element. A "lever element" is to be understood here to mean, in particular, an element mounted such that it can be swiveled at least about an axis of motion of the element and that, in particular, has a maximum extent along a direction that is at least substantially perpendicular to the axis of motion, in order to realize at least one lever arm. Preferably, the lever element is realized as a two-sided lever element that, as viewed in two opposing directions, out from the axis, or from a rotation point, realizes a load arm and a power arm, respectively. It is conceivable for the movement coupling unit to have a multiplicity of lever elements that act in combination with each other, or are connected to each other, for the purpose of moving the tensioning element as a result of a movement of the tool holding element. Advantageously, by means of the configuration according to the disclosure, a stepped-up force can be produced for the purpose of moving the tensioning element. Thus, advantageously, a small actuating force, applied by an operator to actuate the tool holding element, can be stepped up to a large actuating force of the tensioning element.

Moreover, in an alternative configuration of the tool coupling device, it is proposed that the movement coupling unit comprise at least one eccentric element, which is realized so as to be integral with the tool holding element. An "eccentric element" is to be understood here to mean, in particular, an element mounted such that it can be swiveled at least about an axis of motion of the element, a mid-point, in particular a symmetry mid-point, of the element being disposed outside of the axis of motion. The eccentric element in this case may be directly or indirectly coupled to the tensioning element. "Integral with" is to be understood to mean, in particular, connected at least by adhesive force, for example by a welding process, an adhesive bonding process, an injection process and/or another process considered appropriate by persons skilled in the art, and/or, advantageously, formed in one piece such as, for example, by being produced from a casting and/or by being produced in a single or multi-component injection process and, advantageously, from a single blank. Advantageously, a movement of the operating element can be converted to a movement of the tensioning element.

It is additionally proposed that the tool holding unit have at least one fixing element provided to fix the tool holding element in at least one position. Advantageously, unintentional movement of the tool holding element can be prevented as a result. Preferably, the fixing element is mounted in a swiveling manner. It is also conceivable, however, for the fixing element to be mounted in a translationally movable manner. The configuration according to the disclosure makes it possible, advantageously, to make use of a lever principle for actuation of the fixing element. A fixing element that is easy to operate can thus be achieved.

The disclosure is additionally based on a portable power tool comprising a tool coupling device according to the disclosure. The tool coupling device is preferably provided for form-closed and/or force-closed coupling to a power-tool parting device. A "portable power tool" is to be understood here to mean, in particular, a power tool, in particular a hand power tool, that can be transported by an operator without the use of a transport machine. The portable power tool has, in particular, a mass of less than 40 kg, preferably less than 10 kg, and particularly preferably less than 5 kg. Advantageously, it is possible to achieve a portable power tool on which a power-tool parting device can be arranged in a particularly convenient manner.

The disclosure is additionally based on a power tool system comprising a power tool according to the disclosure, and comprising a power-tool parting device, which has at least one cutting strand and has at least one guide unit that, together with the cutting strand, forms a closed system. A "cutting strand" is to be understood here to mean, in particular, a unit provided to locally undo an atomic coherence of a workpiece on which work is to be performed, in particular by means of a mechanical parting-off and/or by means of a mechanical removal of material particles of the workpiece. Preferably, the cutting strand is provided to separate the workpiece into at least two parts that are physically separate from each other, and/or to part off and/or remove, at least partially, material particles of the workpiece, starting from a surface of the workpiece. The cutting strand is preferably realized as a cutting chain. It is also conceivable, however, for the cutting strand to be of another configuration, considered appropriate by persons skilled in the art, such as, for example, configured as a cutting cord, to which cutting elements are fixed. The expression "guide unit" is intended here to define, in particular, a unit provided to exert a constraining force upon the cutting strand, at least along a direction perpendicular to a cutting direction of the cutting strand, in order to define a movement capability of the cutting strand along the cutting direction. A "cutting direction" is to be understood here to mean, in particular, a direction along which the cutting strand is moved, in at least one operating state, as a result of a driving force and/or a driving torque, in particular in the guide unit, for the purpose of producing a cut and/or parting-off and/or removing material particles of a workpiece on which work is to be performed. Preferably, the cutting strand, when in an operating state, is moved, relative to the guide unit, along the cutting direction. The term "closed system" is intended here to define, in particular, a system comprising at least two components that, by means of combined action, when the system has been demounted from a system, in particular the tool coupling device, that is of a higher order than the system, maintain a functionality and/or are inseparably connected to each other when in the demounted state. Preferably, the at least two components of the closed system are connected to each other so as to be at least substantially inseparable by an operator. "At least substantially inseparable" is to be understood here to mean, in particular, a connection of at least two components that can be separated from each other only with the aid of parting tools such as, for example, a saw, in particular a mechanical saw, etc. and/or chemical parting means such as, for example, solvents, etc.

In particular, the power-tool parting device, as viewed along a direction that is at least substantially perpendicular to a cutting plane of the power-tool parting device, has a maximum dimension of less than 10 mm, preferably less than 8 mm, and particularly preferably less than 5 mm. Preferably, the dimension is realized as the width of the power-tool parting device. Particularly preferably, the power-tool parting device, as viewed along the direction that is at least substantially perpendicular to the cutting plane of the power-tool parting device, has a maximum dimension that is at least substantially constant along a total length of the power-tool parting device. The power-tool parting device is thus preferably provided to produce a cut that has a maximum dimension of less than 5 mm, as viewed along the direction that is at least substantially perpendicular to the cutting plane of the power-tool parting device. The configuration according to the disclosure makes it possible, advantageously, to achieve a power tool system that can be adapted in a particularly convenient manner to differing fields of application in that, advantageously, the power-tool parting device can be removed from the tool coupling device.

The tool coupling device according to the disclosure, the portable power tool according to the disclosure and/or the power tool system according to the disclosure is/are not intended in this case to be limited to the application and embodiment described above. In particular, the tool coupling device according to the disclosure, the portable power tool according to the disclosure and/or the power tool system according to the disclosure may have individual elements, components and units that differ in number from the number stated herein, in order to fulfill a principle of function described herein.

BRIEF DESCRIPTION OF THE DRAWINGS

Further advantages are given by the following description of the drawing. The drawing shows exemplary embodiments of the disclosure. The drawing and the description contain numerous features in combination. Persons skilled in the art will also expediently consider the features individually and combine them to create appropriate further combinations.

There are shown in the drawing.

DETAILED DESCRIPTION

Figure 1:
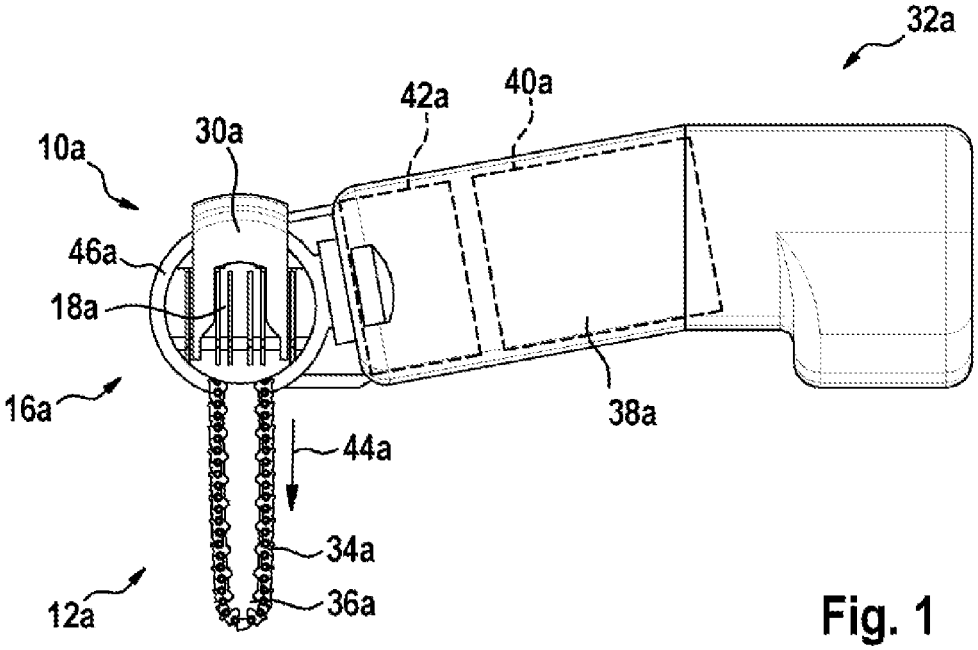
FIG. 1 a portable power tool according to the disclosure, having a tool coupling device according to the disclosure, in a schematic representation, FIG. 2 a detail view of the tool coupling device according to the disclosure, in a schematic representation, FIG. 3 a sectional view of the tool coupling device according to the disclosure, in a schematic representation, FIG. 4 a detail view of a movement coupling element of a movement coupling unit of the tool coupling device according to the disclosure, in a schematic representation, FIG. 5 a side view of the tool coupling device according to the disclosure, with a power-tool parting device disposed in the tool coupling device according to the disclosure, in a schematic representation, FIG. 6 a further side view of the tool coupling device according to the disclosure, with the power-tool parting device disposed in the tool coupling device according to the disclosure, in a schematic representation, FIG. 7 a detail view of an alternative tool coupling device according to the disclosure, in a schematic representation, FIG. 8 a sectional view of the alternative tool coupling device according to the disclosure, in a schematic representation, FIG. 9 an exploded view of the alternative tool coupling device according to the disclosure, in a schematic representation, FIG. 10 a detail view of a further, alternative tool coupling device according to the disclosure, in a schematic representation, FIG. 11 a further detail view of the further, alternative tool coupling device according to the disclosure, in a schematic representation, FIG. 12 a sectional view of the further, alternative tool coupling device according to the disclosure, in a schematic representation, FIG. 13 a detail view of a further, alternative tool coupling device according to the disclosure, in a schematic representation, FIG. 14 a sectional view of the further, alternative tool coupling device according to the disclosure from FIG. 13, in a schematic representation, FIG. 15 a detail view of a further, alternative tool coupling device according to the disclosure, in a schematic representation, FIG. 16 a further detail view of the further, alternative tool coupling device according to the disclosure from FIG. 15, in a schematic representation, FIG. 17 a detail view of a further, alternative tool coupling device according to the disclosure, in a schematic representation, FIG. 18 a further detail view of the further, alternative tool coupling device according to the disclosure from FIG. 17, in a schematic representation, FIG. 19 a detail view of a further, alternative tool coupling device according to the disclosure, in a schematic representation, FIG. 20 a further detail view of the further, alternative tool coupling device according to the disclosure from FIG. 19, in a schematic representation, FIG. 21 a sectional view of the further, alternative tool coupling device according to the disclosure from FIG. 19, in a schematic representation.

FIG. 1 shows a portable power tool 32*a*, having a power-tool parting device 12*a* disposed on a tool coupling device 10*a* of the portable power tool 32*a*. The portable power tool 32*a* and the power-tool parting device 12*a* together form a power tool system. The power-tool parting device 12*a* comprises at least one cutting strand 34*a*, and at least one guide unit 36*a* for guiding the cutting strand 34*a*. The guide unit 36*a* and the cutting strand 34*a* together form a closed system. The power-tool parting device 12*a* is thus realized as a closed system. The portable power tool 32*a* has the tool coupling device 10*a* for coupling the power-tool parting device 12*a* in a form-closed and/or force-closed manner. The tool coupling device 10*a* is provided to receive the power-tool parting device 12*a* realized as a closed system. The tool coupling device 10*a* in this case comprises at least one cutting-strand tensioning unit 14*a*, for generating a cutting-strand tensioning force, and at least one tool holding unit 16*a*, which comprises at least one movably mounted tool holding element 18*a*.

Moreover, the portable power tool 32*a* has a power-tool housing 38*a*, which encloses a drive unit 40*a* and an output transmission unit 42*a* of the portable power tool 32*a*. The drive unit 40*a* and the output transmission unit 42*a* are operatively connected to each other, in a manner already known to persons skilled in the art, for the purpose of generating a drive torque that can be transmitted to the power-tool parting device 12*a*. The output transmission unit 42*a* is realized as a bevel gear transmission. The drive unit 40*a* is realized as an electric motor unit. It is also conceivable, however, for the drive unit 40*a* and/or the output transmission unit 42*a* to be of a different configuration, considered appropriate by persons skilled in the art, such as, for example, the drive unit 40*a* being configured as a hybrid drive unit or as an internal combustion drive unit, etc., and/or the output transmission unit 42*a* being configured as a worm gear transmission, etc. The drive unit 40*a* is provided to drive the cutting strand 34*a* of the power-tool parting device 12*a*, in at least one operating state, via the output transmission unit 42*a*. The cutting strand 34*a* in this case is moved in the guide unit 36*a* of the power-tool parting device 12*a*, along a cutting direction 44*a* of the cutting strand 34*a*, relative to the guide unit 36*a*.

Figure 2:
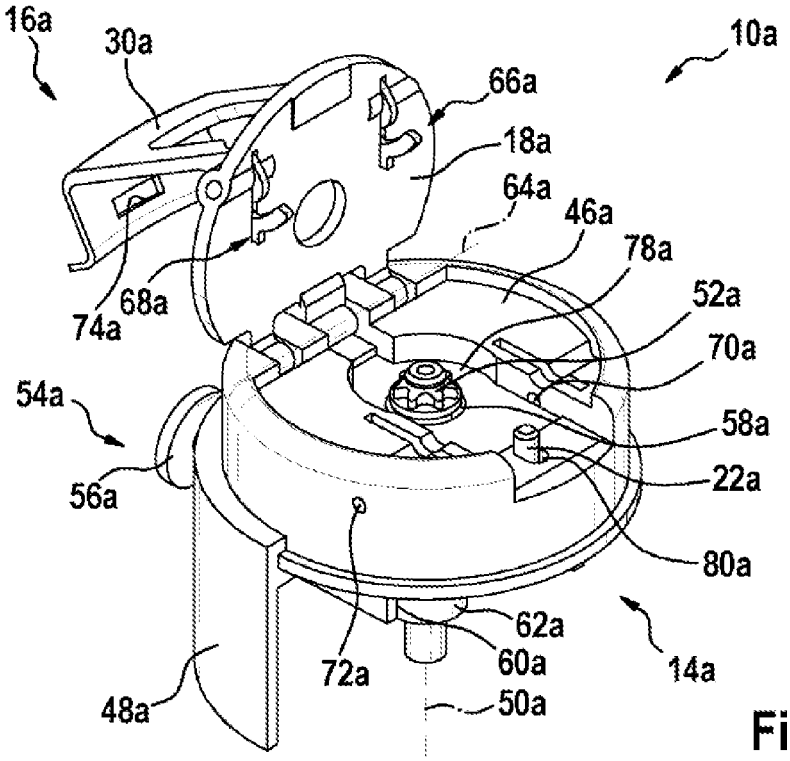

FIG. 2 shows the tool coupling device 10*a* demounted from the portable power tool 32*a*. The tool coupling device 10*a* comprises a main body 46*a*, which is mounted in a rotatable manner in a connection housing 48*a* of the tool coupling device 10*a*. The main body 46*a* in this case is mounted in the connection housing 48*a* so as to be rotatable about a rotation axis 50*a* of a drive element 52*a* of the tool coupling device 10*a*. When the tool coupling device 10*a* is mounted on the portable power tool 32*a*, the connection housing 48*a* is fixed to the power-tool housing 38*a* of the portable power tool 32*a*. The tool coupling device 10*a* has at least one rotary positioning unit 54*a*, for fixing a rotary position of the main body 46*a* relative to the connection housing 48*a*. The rotary positioning unit 54*a* in this case comprises at least one positioning element 56*a*, for fixing the main body 46*a* in a position relative to the connection housing 48*a*. The positioning element 56*a* in this case is realized as a spring-biased locking pin, which acts in combination with positioning recesses (not represented in greater detail here) of the main body 46*a*, in a manner already known to persons skilled in the art. It is also conceivable, however, for the rotary positioning unit 54*a* to be of a different configuration, considered appropriate by persons skilled in the art, such as, for example, configured as tooth system.

The main body 46*a* additionally has a rotary play opening 58*a* (FIG. 3), in which the drive element 52*a* of the tool coupling device 10*a* is disposed. In this case, the drive element 52*a*, as viewed along a direction that is at least substantially perpendicular to the rotation axis 50*a* of the drive element 52*a*, is disposed, relative to the main body 46*a*, at a distance from an edge region of the main body 46*a* that delimits the rotary play opening 58*a*. The drive element 52*a* is realized as a driving toothed wheel. The connection housing 48*a* comprises a bearing recess 60*a*, in which there is disposed a bearing element 62*a* of the tool coupling device 10*a*, for rotatably mounting the drive element 52*a*. The bearing element 62*a* is realized as a bearing sleeve. It is also conceivable, however, for the bearing element 62*a* to be realized as a rolling bearing. The drive element 52*a* is provided to transmit a driving force of the drive unit 40*a* to the cutting strand 34*a*. Thus, when power-tool parting device 12*a* is connected to the tool coupling device 10*a*, the drive element 52*a* engages in the cutting strand 34*a*. The drive element 52*a* in this case engages in drive recesses of cutting strand segments of the cutting strand 34*a* (not represented in greater detail here). In addition, when the tool coupling device 10*a* is mounted on the portable power tool 32*a*, the drive element 52*a* is connected to an output element (not represented in greater detail here) of the output transmission unit 42*a* in a rotationally fixed manner.

Furthermore, the tool holding element 18*a* of the tool holding unit 16*a* of the tool coupling device 10*a* is mounted such that it can swivel about an axis of motion 64*a* of the tool holding element 18*a* that is at least substantially parallel to a plane of main extent of the tool holding element 18*a*. The tool holding element 18*a* in this case is mounted in a swiveling manner on the main body 46*a*. The axis of motion 64*a* of the tool holding element 18*a*, as viewed in a plane of projection into which the axis of motion 64*a* and the rotation axis 50*a* of the drive element 52*a* are projected, is at least substantially perpendicular to the rotation axis 50*a*. The tool holding element 18*a* is mounted such that it can swivel by less than 120° relative to the main body 46*a*. It is also conceivable, however, for the tool holding element 18*a* to be mounted such that it can swivel by an angle other than 90° relative to the main body 46*a*.

Figure 5:
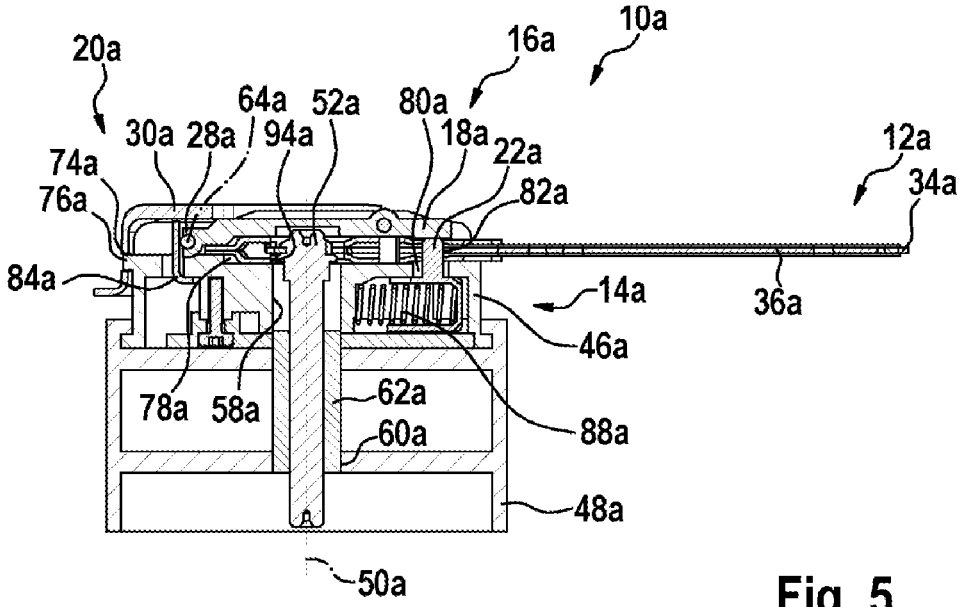
Figure 6:
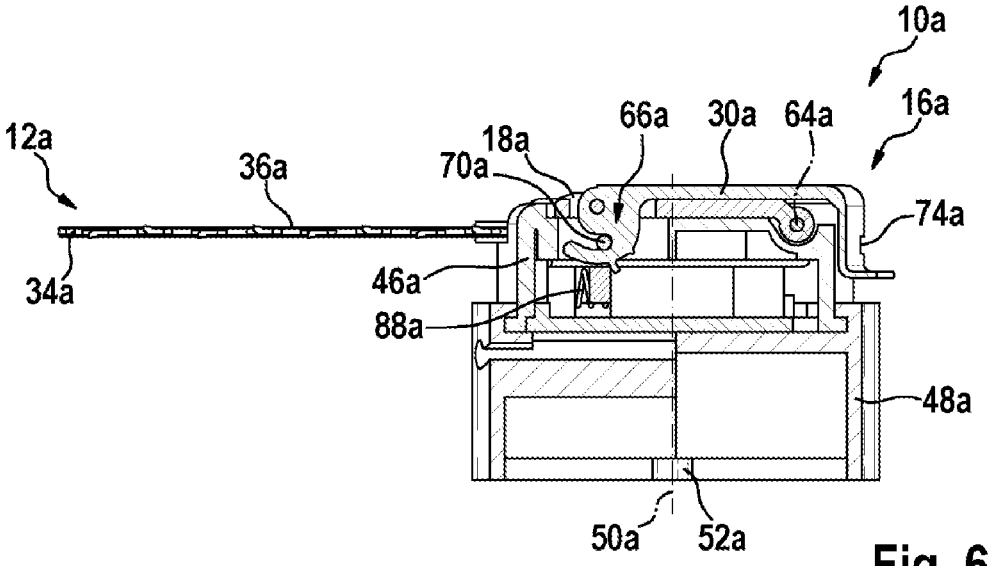

The tool holding unit 16*a* additionally has at least one fixing element 30*a* provided to fix the tool holding element 18*a* in at least one position. The fixing element 30*a* is provided to fix the tool holding element 18*a* in a tool fixing position of the tool holding element 18*a*. For this purpose, the fixing element 30*a* is mounted in a swiveling manner. The fixing element 30*a* in this case is mounted in a swiveling manner on the tool holding element 18*a*. The fixing element 30*a* comprises at least two latching regions 66*a*, 68*a*. It is also conceivable, however, for the fixing element 30*a* to have a number of latching regions 66*a*, 68*a* other than two. The latching regions 66*a*, 68*a*, as viewed in a plane that is at least substantially perpendicular to the plane of main extent of the tool holding element 18*a*, or as viewed in a plane that is at least substantially parallel to the rotation axis 50*a* of the drive element 52*a*, are arcuate in form and each delimit an arcuate latching recess. Moreover, when the fixing element 30*a* is in an operating-element fixing position, the latching regions 66*a*, 68*a* act in combination with fixing studs 70*a*, 72*a* of the tool holding unit 16*a* (FIG. 6). The fixing studs 70*a*, 72*a* are fixed to the main body 46*a*. The fixing element 30*a* is thus provided to fix the tool holding element 18*a* in the tool fixing position by means of a form-closed connection. For the purpose of securing the fixing element 30*a* in the tool-holding element fixing position, the fixing element 30*a* additionally has a securing recess 74*a*, which acts in combination with a latching extension 76*a* of the tool holding unit 16*a* when the fixing element 30*a* is in the tool-holding element fixing position (FIG. 5). The latching extension 76*a* in this case is disposed on the main body 46*a*. The latching extension 76*a* in this case is integrally formed on to the main body 46*a*. It is also conceivable, however, for the latching extension 76*a* to be realized separately from the main body 46*a*, and to be fastened to the main body 46*a* by means of a fastening element considered appropriate by persons skilled in the art.

When the power-tool parting device 12*a* is coupled to the tool coupling device 10*a*, the power-tool parting device 12*a*, in particular the guide unit 36*a*, in the tool fixing position, is subjected to a clamping force in the direction of the main body 46*a* by means of the tool holding element 18*a*, in a receiving recess 78*a* of the main body 46*a*. This clamping force is generated by means of a swivel movement of the tool holding element 18*a* in the direction of the receiving recess 78*a* and by means of a combined action of the fixing element 30*a* and the fixing studs 70*a*, 72*a* when the tool holding element 18*a* is in the tool fixing position. When the tool holding element 18*a* is in a tool fixing position, the tool holding element 18*a*, for the purpose of generating a holding force in the direction of the main body 46*a*, bears against an outer face of the guide unit 36*a*. The tool holding element 18*a* holds the power-tool parting device 12*a*, in particular the guide unit 36*a*, in the tool fixing position of the tool holding element 18*a* as the result of a clamping force in the receiving recess 78*a* of the main body 46*a*. The tool holding unit 16*a* is thus provided to act upon the power-tool parting device 12*a*, when the power-tool parting device 12*a* is coupled to the tool coupling device 10*a*, in a direction that is at least substantially parallel to the rotation axis 50*a* of the drive element 52*a*. It is also conceivable, however, for the tool holding unit 16*a* to be of a different configuration, considered appropriate by persons skilled in the art.

Moreover, when the power-tool parting device 12*a* is coupled to the tool coupling device 10*a*, the power-tool parting device 12*a* is secured in a form-closed manner, by means of the receiving recess 78*a* of the main body 46*a*, against a rotational movement along a direction of rotation about the rotation axis 50*a* of the drive element 52*a*. The receiving recess 78*a* thus constitutes at least one power-tool parting-device torque holding element of a power-tool parting-device torque holding unit. For this purpose, the receiving recess 78*a* has a shape that corresponds to an external shape of at least one partial region of the power-tool parting device 12*a*, in particular a partial region of the guide unit 36*a*. The receiving recess 78*a* is thus realized as a negative shape of at least one partial region of the power-tool parting device 12*a*, in particular a partial region of the guide unit 36*a*. It is also conceivable, however, for the main body 46*a* to be of another configuration, considered appropriate by persons skilled in the art, that can prevent, insofar as possible, a rotational movement of the power-tool parting device 12*a* when the power-tool parting device 12*a* is coupled to the tool coupling device 10*a*.

Figure 3:
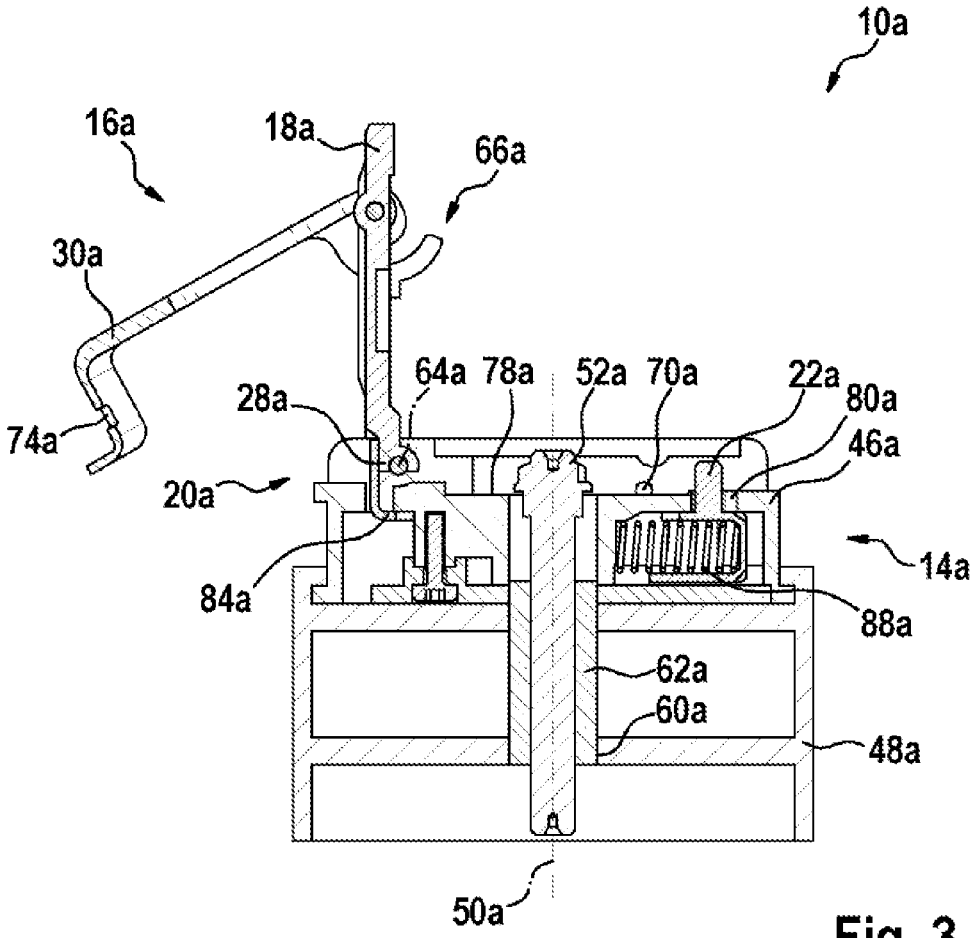

Furthermore, the tool coupling device 10*a* comprises at least one movement coupling unit 20*a*, by means of which, for the purpose of moving a tensioning element 22*a* of the cutting-strand tensioning unit 14*a*, the tool holding element 18*a* can be coupled to the tensioning element 22*a*. The tensioning element 22*a* in this case is mounted in a translationally movable manner in a guide recess 80*a* of the main body 46*a*. The guide recess 80*a* is disposed in the receiving recess 78*a*. The tensioning element 22*a* is realized as a tensioning stud, which engages in a tensioning recess 82*a* (FIG. 5) of the power-tool parting device 12*a* when the power-tool parting device 12*a* is coupled to the tool coupling device 10*a*. The tensioning element 22*a* is realized so as to be integral with a movement coupling element 84*a* of the movement coupling unit 20*a*. It is also conceivable, however, for the tensioning element 22*a* to be realized so as to be separate from the movement coupling element 84*a*, and to be fixed to the movement coupling element 84*a* by means of a form-closed and/or force-closed connection. The movement coupling element 84*a* is mounted in a translationally movable manner in the main body 46*a*. In addition, the movement coupling element 84*a* comprises an actuating region 86*a*, which acts in combination with a transmission element of the movement coupling unit 20*a* for the purpose of moving the tensioning element 22*a* as a result of a movement of the tool holding element 18*a*. The transmission element of the movement coupling unit 20*a* in this case is realized as an eccentric element 28*a* (FIG. 3). The movement coupling unit 20*a* thus comprises at least the eccentric element 28*a*, which acts in combination with the tensioning element 22*a* for the purpose of moving the tensioning element 22*a* as a result of a movement of the tool holding element 18*a*, via the movement coupling element 84*a*. The eccentric element 28*a* is realized so as to be integral with the tool holding element 18*a* (FIG. 3). The eccentric element 28*a* is disposed on the tool holding element 18*a*, eccentrically, or asymmetrically, in relation to the axis of motion 64*a* of the tool holding element 18*a*.

Moreover, the cutting-strand tensioning unit 14*a* has at least one spring element 88*a*, which is provided to apply a spring force to the tensioning element 22*a*. The spring element 88*a* in this case is supported with one end on the main body 46*a* and, with another end, the spring element 88*a* is supported on a tensioning force support region 90*a* of the movement coupling element 84*a*. It is additionally conceivable that, for the purpose of supporting a tensioning force of the tensioning element 22*a*, the movement coupling element 84*a* an additional clamping and/or locking of the movement coupling element 84*a* on the main body 46*a* is possible, such as, for example, by a rough surface of the movement coupling element 84*a* or by a locking unit, etc.

Figure 4:
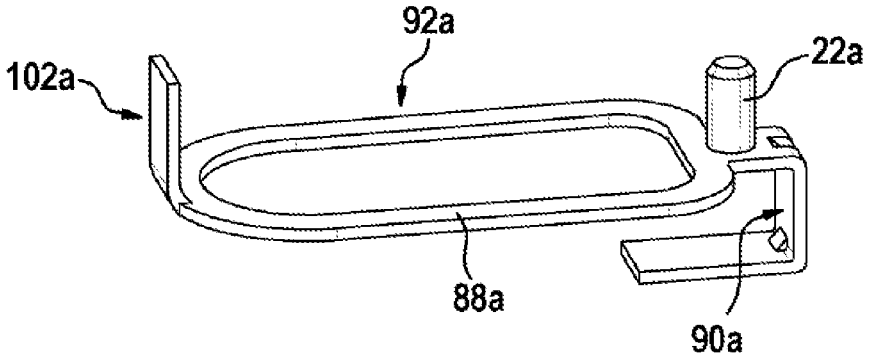

The tensioning force support region 90*a* and the actuating region 86*a* of the movement coupling element 84*a* in this case are connected to each other via a connecting region 92*a* of the movement coupling element 84*a*. The connecting region 92*a* has an elliptical shape (FIG. 4). When the tool holding element 18*a* is in a position in which it has been swiveled away from the main body 46*a*, the spring element 88*a* is compressed as a result of a combined action of the eccentric element 28*a* and the actuating region 86*a* of the movement coupling element 84*a*. As a result, the tensioning element 22*a* is moved into a guide-unit insertion position.

For the purpose of coupling the power-tool parting device 12*a* to the tool coupling device 10*a*, the power-tool parting device 12*a* is inserted in the receiving recess 78*a* of the main body 46*a*, along a direction that is at least substantially parallel to the rotation axis 50*a* of the drive element 52*a*. The tool holding element 18*a* in this case is disposed in the position in which it has been swiveled away from the main body 46*a*. As the power-tool parting device 12*a* is inserted in the receiving recess 78*a*, the drive element 52*a* is introduced into a coupling recess 94*a* of the guide unit 36*a* (FIG. 5). As a result, the cutting strand 34*a* engages with the drive element 52*a*. In addition, the tensioning element 22*a* is introduced into the tensioning recess 82*a* of the guide unit 36*a*.

As a result of the tool holding element 18*a* being moved into the tool fixing position, the eccentric element 28*a* releases the actuating region 86*a* of the movement coupling element 84*a*. The movement coupling element 84*a*, together with the tensioning element 22*a*, is thus moved by a spring force of the spring element 88*a*, translationally in a direction away from the drive element 52*a*, into a tensioning position of the tensioning element 22*a*. As a result, the guide unit 36*a* is moved relative to the drive element 52*a*. This causes the cutting strand 34*a* to be tensioned by the spring force of the spring element 88*a*, or by the movement of the tensioning element 22*a*. A cutting-strand tensioning force, for tensioning the cutting strand 34*a*, is achieved as a result. Thus, automatic tensioning of the cutting strand 34*a* is effected as a result of the power-tool parting device 12*a* being clamped in the receiving recess 78*a* of the main body 46*a* by means of the tool holding unit 16*a*. The power-tool parting device 12*a*, when coupled to the tool coupling device 10*a*, is thus clamped in the receiving recess 78*a*, between the tool holding element 18*a* and the main body 46*a*, by means of the tool holding unit 16*a*. Moreover, the fixing of the tool holding element 18*a* by means of the fixing element 30*a* results in self-locking of the cutting-strand tensioning unit 14*a*, in order to avoid unwanted removal of a cutting-strand tensioning force for tensioning the cutting strand 34*a*.

Alternative exemplary embodiments are represented in FIGS. 7 to 21. Components, features and functions that remain substantially the same are denoted basically by the same references. To differentiate the exemplary embodiments, the letters a to g have been appended to the references of the exemplary embodiments. The following description is limited substantially to the differences as compared with the first exemplary embodiment described in FIGS. 1 to 6, and reference may be made to the description of the first exemplary embodiment in FIGS. 1 to 6 in respect of components, features and functions that remain the same.

Figure 7:
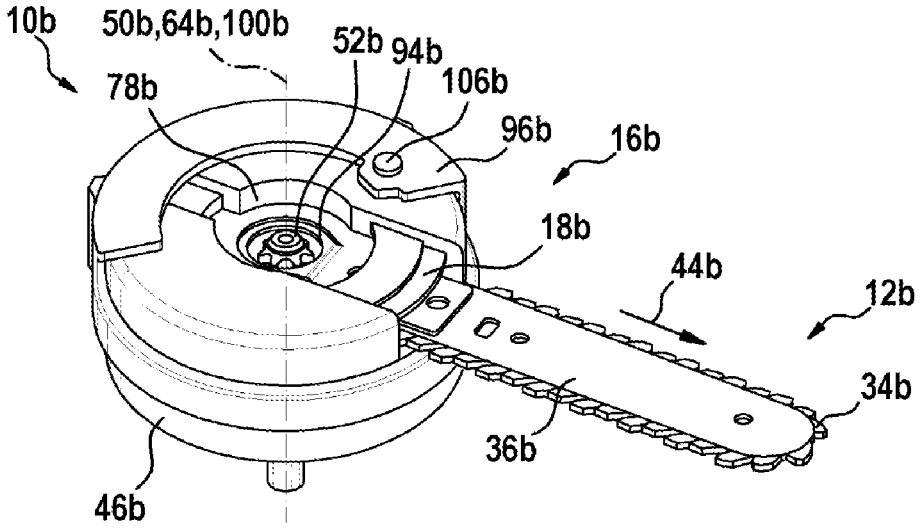

FIG. 7 shows an alternative tool coupling device 10*b*, which is provided to receive a power-tool parting device 12*b* realized as a closed system, demounted from a portable power tool (not represented in greater detail here). The portable power tool is of a configuration similar to that of the portable power tool 32*a* described in FIGS. 1 to 6. The portable power tool and the power-tool parting device 12*b* together form a power tool system. The tool coupling device 10*b* comprises at least one cutting-strand tensioning unit 14*b*, for generating a cutting-strand tensioning force, and at least one tool holding unit 16*b*, which has at least one movably mounted tool holding element 18*b*. The tool holding element 18*b* in this case is mounted so as to be rotatable about an axis of motion 64*b* of the tool holding element 18*b* that is at least substantially perpendicular to a plane of main extent of the tool holding element 18*b*, or about one that is at least substantially parallel to a rotation axis 50*b* of a drive element 52*b* of the tool coupling device 10*b*. The tool holding element 18*b* is provided to apply a clamping force to the power-tool parting device 12*b*, in the direction of a main body 46*b* of the tool coupling device 10*b*, when the tool holding element 18*b* is in a tool fixing position.

The tool holding element 18*b* is realized in the form of a circular-ring segment. In addition, the tool holding element 18*b* is mounted in a rotatable manner in the main body 46*b*. For the purpose of generating a clamping force, the tool holding element 18*b* has a tensioning region 98*b* in the shape of a spiral, or in the shape of a screw thread. The tensioning region 98*b* is disposed on an outer circumference of the tool holding element 18*b*. It is also conceivable, however, for the tensioning region 98*b* to be disposed at another position on the tool holding element 18*b*, considered appropriate by persons skilled in the art, such as, for example, on an inner circumference of the tool holding element 18*b*. The tensioning region 98*b* has a slope, as viewed along a circumferential direction extending around the rotation axis 50*b* of the drive element 52*b*. Along a total extent of the tensioning region 98*b*, therefore, the tensioning region 98*b* is sloped relative to a plane of main extent of the tool holding element 18*b*. The tensioning region 98*b*, for the purpose of generating a clamping force, acts in combination with a tensioning slot (not represented in greater detail here) of the main body 46*b*, in which the tensioning region 98*b* engages. In addition, the tool holding unit 16*b* comprises at least one operating element 96*b* for actuating, or moving, the tool holding element 18*b*.

Figure 9:
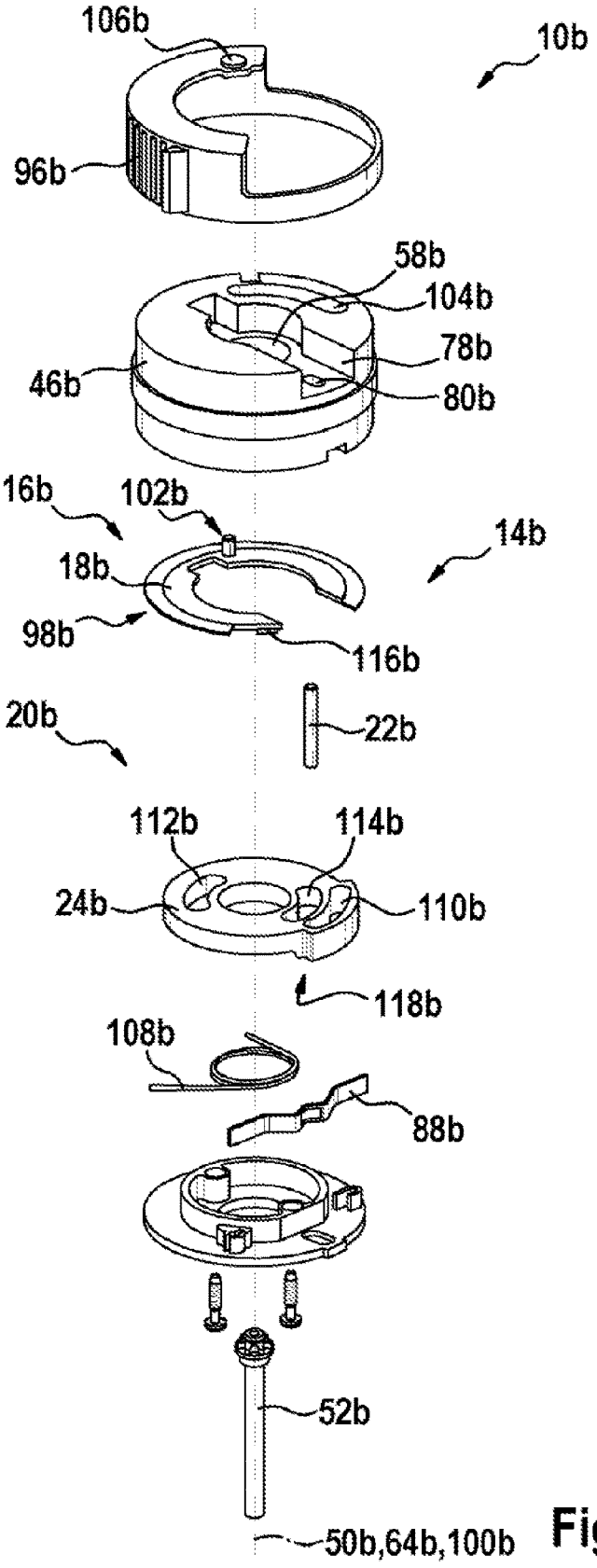

For the purpose of moving the tool holding element 18*b*, the operating element 96*b* is rotated about a rotation axis 100*b* of the operating element 96*b*. The rotation axis 100*b* of the operating element 96*b* in this case is at least substantially parallel to the rotation axis 50*b* of the drive element 52*b*. For the purpose of rotationally driving the tool holding element 18*b* as a result of a rotational movement of the operating element 96*b*, the tool holding element 18*b* comprises a stud-type actuating region 102*b* (FIG. 9). When the tool holding element 18*b* is in a mounted state, the actuating region 102*b* is disposed in a movement guide recess 104*b* of the main body 46*b*, which movement guide recess is in the shape of a circular-ring segment (FIG. 9). The operating element 96*b* has a movement transmission element 106*b*, which is provided to receive the actuating region 102*b* of the tool holding element 18*b*. The movement transmission element 106*b* is realized as a cup-shaped hollow, which is realized so as to correspond to the stud-type actuating region 102*b* of the tool holding element 18*b*. It is also conceivable, however, for the movement transmission element 106*b* to be of another configuration, considered appropriate by persons skilled in the art, such as, for example, configured as a circular through-hole, etc.

Furthermore, the tool coupling device 10*b* comprises at least one movement coupling unit 20*b*, by means of which the tool holding element 18*b*, for the purpose of moving a tensioning element 22*b* of the cutting-strand tensioning unit

Figure 8:
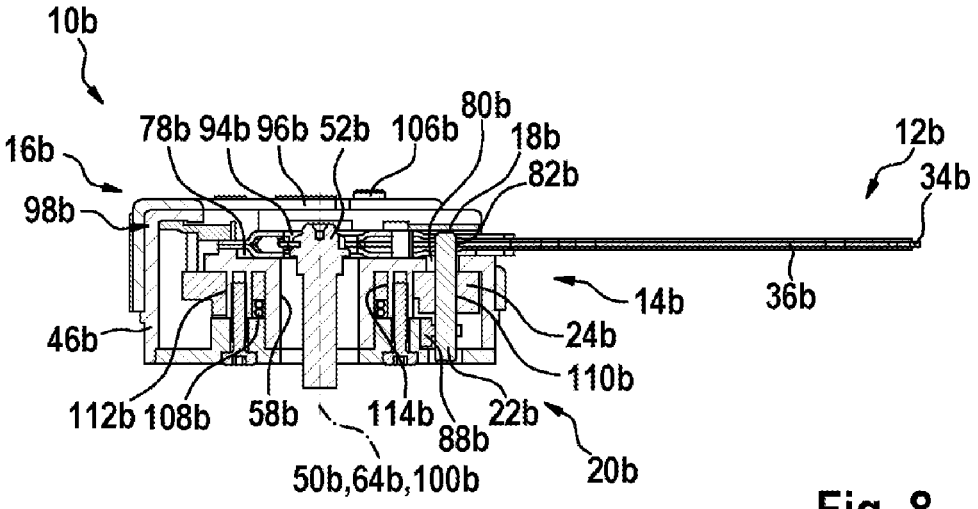

14*b*, can be coupled to the tensioning element 22*b*. The tensioning element 22*b* in this case is mounted in a translationally movable manner in a guide recess 80*b* of the main body 46*b* of the tool coupling device 10*b*. The movement coupling unit 20*b* has at least one gate element 24*b* for moving the tensioning element 22*b* as a result of a movement of the tool holding element 18*b*. The gate element 24*b* in this case is mounted in a rotatable manner. Moreover, the gate element 24*b* is realized as a gate disk, which has at least one tensioning-element guide gate 110*b* and at least two gate-element guide recesses 112*b*, 114*b* (FIG. 9). In this case, the tensioning element 22*b*, when in a mounted state, is disposed in the tensioning-element guide gate 110*b*. The tensioning-element guide gate 110*b* in this case has a spiral course in relation to the rotation axis 50*b* of the drive element 52*b*. In addition, the cutting-strand tensioning unit 14*b* comprises at least one spring element 88*b*, which is provided to apply a spring force to the tensioning element 22*b* (FIGS. 8 and 9). The spring element 88*b* is realized as a spring plate, which applies a spring force to the tensioning element 22*b* in the direction of a tensioning position of the tensioning element 22*b*. The movement coupling unit 20*b* additionally comprises at least one gate spring element 108*b*, which is provided to apply a spring force to the gate element 24*b* (FIGS. 8 and 9). The gate spring element 108*b* is realized as a leg spring. The gate spring element 108*b* in this case is supported with one end on the main body 46*b* and, with another end, the gate spring element 108*b* is supported on the gate element 24*b*.

The gate element 24*b* is moved against the spring force of the gate spring element 108*b* by means of the tool holding element 18*b*, or by means of a rotational movement of the operating element 96*b*, by the tool holding element 18*b*. For this purpose, the tool holding element 18*b* has a driving extension 116*b*, which extends in the direction of the gate element 24*b*. The driving extension 116*b* acts in combination with a movement driving region 118*b* of the gate element 24*b* for the purpose of moving the gate element 24*b* (FIG. 9). As a result, the gate element 24*b* is moved, at least in one direction, in dependence on a movement of the tool holding element 18*b*, together with the tool holding element 18*b*. A movement of the gate element 24*b* causes the tensioning element 22*b* to be moved, by means of the tensioning-element guide gate 110*b*, into a guide-unit insertion position. In addition, the tool holding element 18*b* releases a receiving recess 78*b* of the main body 46*b*, for the purpose of receiving the power-tool parting device 12*b*. The guide recess 80*b*, in which the tensioning element 22*b* is guided, is disposed in the region of the receiving recess 78*b* on the main body 46*b*.

After the receiving recess 78*b* has been released and the clamping element 22*b* has moved into the guide-unit insertion position as a result of a movement of the tool holding element 18*b*, the power-tool parting device 12*b* can be inserted in the receiving recess 78*b*, along a direction that is at least substantially parallel to the rotation axis 50*b* of the drive element 52*b*. A rotational movement of the operating element 96*b* then causes the tool holding element 18*b* to be moved into a clamping position, causing a clamping force to be exerted upon the power-tool parting device 12*b* in the direction of the main body 46*b*. In addition, the gate element 24*b* is turned as a result of the spring force of the gate spring element 108*b*, and the tensioning element 22*b* is moved translationally in the guide recess 80*b* by means of the tensioning-element guide gate 110*b*. As a result, a guide unit 36*b* of the power-tool parting device 12*b* is moved relative to the drive element 52*b*. This results in tensioning of a cutting strand 34*b* of the power-tool parting device 12*b* by the spring force of the spring element 88*b* and of the gate spring element 108*b*, or by the movement of the tensioning element 22*b*. Thus, automatic tensioning of the cutting strand 34*b* is effected as a result of the power-tool parting device 12*b* being clamped in the receiving recess 78*b* of the main body 46*b*.

The tensioning-element guide gate 110*b* in this case is realized in such a manner that, by means of the tensioning-element guide gate 110*b* acting in combination with the spring element 88*b* and the gate spring element 108*b*, a movement of the tensioning element 22*b* into a guide-unit insertion position is effected in a self-locking manner. Moreover, the gate spring element 108*b* acts, via the gate element 24*b*, upon the tool holding element 18*b*, which, in turn, acts upon the operating element 96*b*. As a result, the spring force of the gate spring element 108*b* forces the tool holding element 18*b* into the clamping position. It is also conceivable, however, for the tool holding element 18*b*, or the operating element 96*b*, to be mounted in isolation from the spring force, and to be held in the clamping position by means of a fixing unit of the tool coupling device 10*b*.

Figure 10:
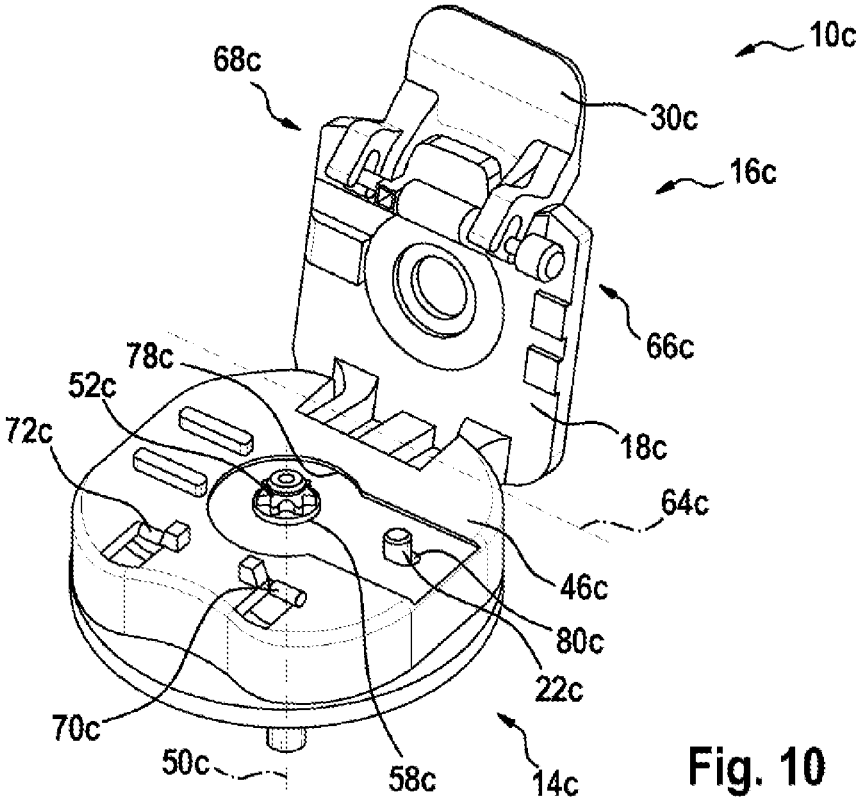

FIG. 10 shows a further, alternative tool coupling device 10*c*, which is provided to receive a power-tool parting device 12*c* realized as a closed system (FIG. 12), demounted from a portable power tool (not represented in greater detail here). The portable power tool is of a configuration similar to that of the portable power tool 32*a* described in FIGS. 1 to 6.

Figure 11:
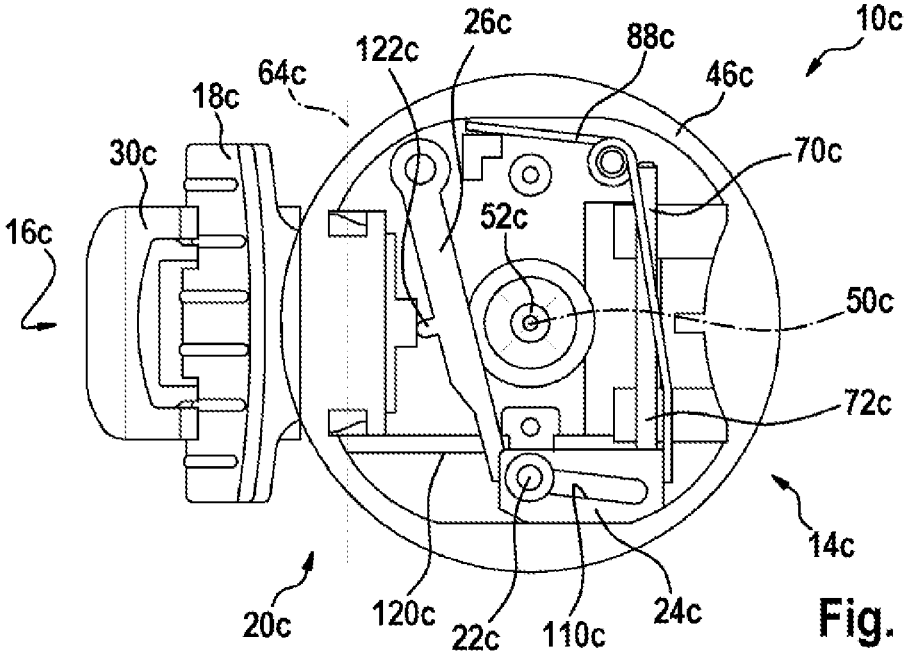

The portable power tool and the power-tool parting device 12*c* together form a power tool system. The tool coupling device 10*c* comprises at least one cutting-strand tensioning unit 14*c*, for generating a cutting-strand tensioning force, and at least one tool holding unit 16*c*, which has at least one movably mounted tool holding element 18*c*. The tool holding element 18*c* is mounted such that it can be swiveled about an axis of motion 64*c* of the tool holding element 18*c* that is at least substantially parallel to a plane of main extent of the tool holding element 18*c*, or about one that is at least substantially perpendicular to a rotation axis 50*c* of a drive element 52*c* of the tool coupling device 10*c*. The tool coupling device 10*c* additionally comprises at least one movement coupling unit 20*c*, by means of which the tool holding element 18*c*, for the purpose of moving a tensioning element 22*c* of the cutting-strand tensioning unit 14*c*, can be coupled to the tensioning element 22*c*. The movement coupling unit 20*c* has at least one gate element 24*c* for moving the tensioning element 22*c* as a result of a movement of the tool holding element 18*c*. The gate element 24*c* is mounted in a translationally movable manner. The gate element 24*c* in this case is guided in an axial bearing recess 120*c* of a main body 46*c* of the tool coupling device 10*c* (FIG. 11). The gate element 24*c* comprises a tensioning-element guide gate 110*c* for moving the tensioning element 22*c*. The tensioning-element guide gate 110*c* extends at least substantially transversely in relation to an axis of motion of the gate element 24*c*. The tensioning-element guide gate 110*c* is thus sloped relative to the axis of motion of the gate element 24*c*.

Figure 12:
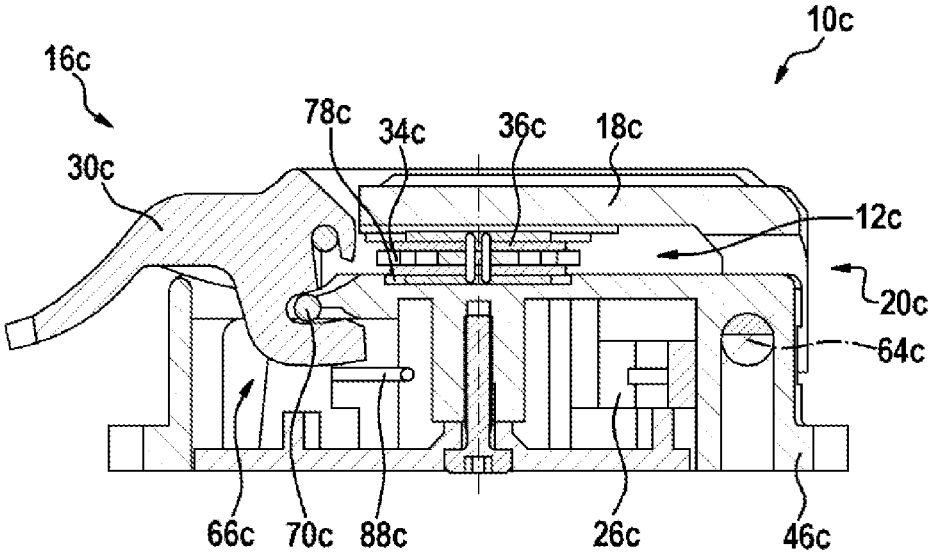

Furthermore, the movement coupling unit 20*c* comprises at least one lever element 26*c*, by means of which the tool holding element 18*c* can be coupled to a gate element 24*c* of the movement coupling unit 20*c*, for the purpose of moving the tensioning element 22*c*. The lever element 26*c* is mounted in the main body 46*c* so as to be rotatable about an axis of motion of the lever element 26*c* that is at least substantially parallel to the rotation axis 50*c* of the drive element 52*c*. For the purpose of moving the gate element 24*c*, the lever element 26*c* bears with one end against the gate element 24*c*. In addition, the lever element 26*c* has an actuating extension 122*c*, which acts in combination with the tool holding element 18*c*. Furthermore, the movement coupling unit 20*c* comprises at least one spring element 88*c*, which is provided to apply a spring force to the gate element 24*c*. The spring element 88*c* is realized as a leg spring. The spring element 88*c* in this case is supported with one end on the main body 46*c* and, with another end, the spring element 88*c* is supported on the gate element 24*c*. The tool holding unit 16*c* additionally has at least one fixing element 30*c* provided to fix the tool holding element 18*c* in at least one position. The fixing element 30*c* is of a configuration similar to that of the fixing element 30*a* described in FIGS. 1 to 6. The fixing element 30*c* thus fixes the tool holding element 18*c* in a tool fixing position of the tool holding element 18*c* (FIG. 12).

For the purpose of coupling the power-tool parting device 12*c* to the tool coupling device 10*c*, the power-tool parting device 12*c* is inserted in a receiving recess 78*c* of the main body 46*c*, along a direction that is at least substantially parallel to the rotation axis 50*c* of the drive element 52*c*. The tool holding element 18*c* in this case is disposed in the position in which it has been swiveled away from the main body 46*c*. As the power-tool parting device 12*c* is inserted in the receiving recess 78*c*, the drive element 52*c* is inserted in a coupling recess 94*c* of a guide unit 36*c* of the power-tool parting device 12*c*. As a result, a cutting strand 34*c* of the power-tool parting device 12*c* engages with the drive element 52*c*. In addition, the tensioning element 22*c* is inserted in a tensioning recess 82*c* of the guide unit 36*a*. As a result of the tool holding element 18*c* being moved into the tool fixing position, the tool holding element 18*c* actuates the lever element 26*c* by means of an eccentric element 28*c* of the movement coupling unit 20*c* that is realized so as to be integral with the tool holding element 18*c*. As a result, the lever element 26*c* is swiveled about the axis of motion of the lever element 26*c*, and actuates the gate element 24*c*. The gate element 24*c* in this case is moved translationally. The tensioning element 22*c* is thus moved into a guide-unit insertion position by the tensioning-element guide gate 110*c*. In respect of further features of the tool coupling device 10*c*, reference may be made to the description of FIGS. 1 to 6.

Figure 13:
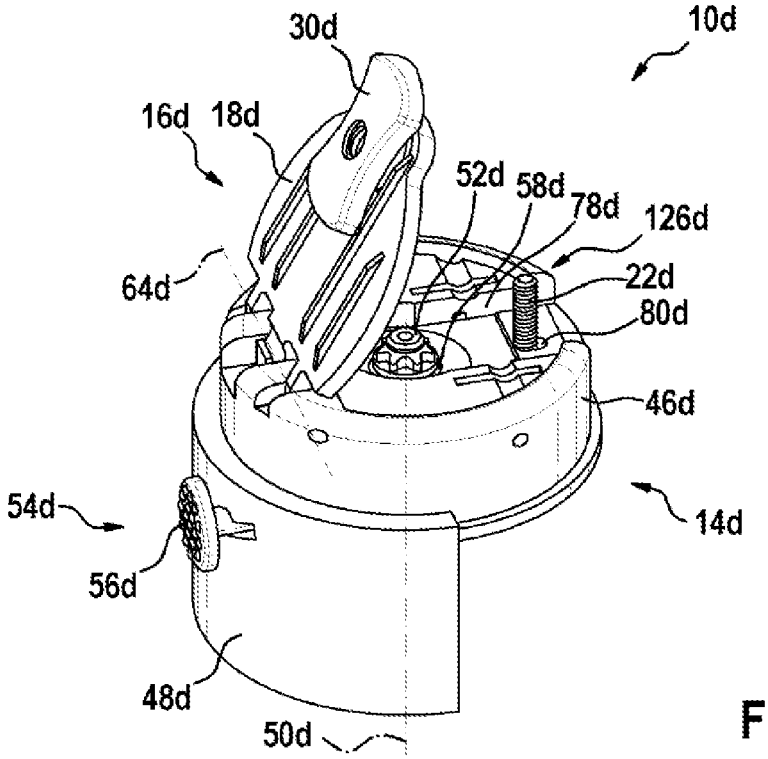

FIG. 13 shows a further, alternative tool coupling device 10*d*, which is provided to receive a power-tool parting device 12*d* realized as a closed system (FIG. 14), demounted from a portable power tool (not represented in greater detail here). The portable power tool is of a configuration similar to that of the portable power tool 32*a* described in FIGS. 1 to 6. The portable power tool and the power-tool parting device 12*d* together form a power tool system. The tool coupling device 10*d* comprises at least one cutting-strand tensioning unit 14*d*, for generating a cutting-strand tensioning force, and at least one tool holding unit 16*d*, which has at least one movably mounted tool holding element 18*d*. The tool holding element 18*d* is mounted such that it can be swiveled about an axis of motion 64*d* of the tool holding element 18*d* that is at least substantially parallel to a plane of main extent of the tool holding element 18*d*, or about one that is at least substantially perpendicular to a rotation axis 50*d* of a drive element 52*d* of the tool coupling device 10*d*.

Figure 14:
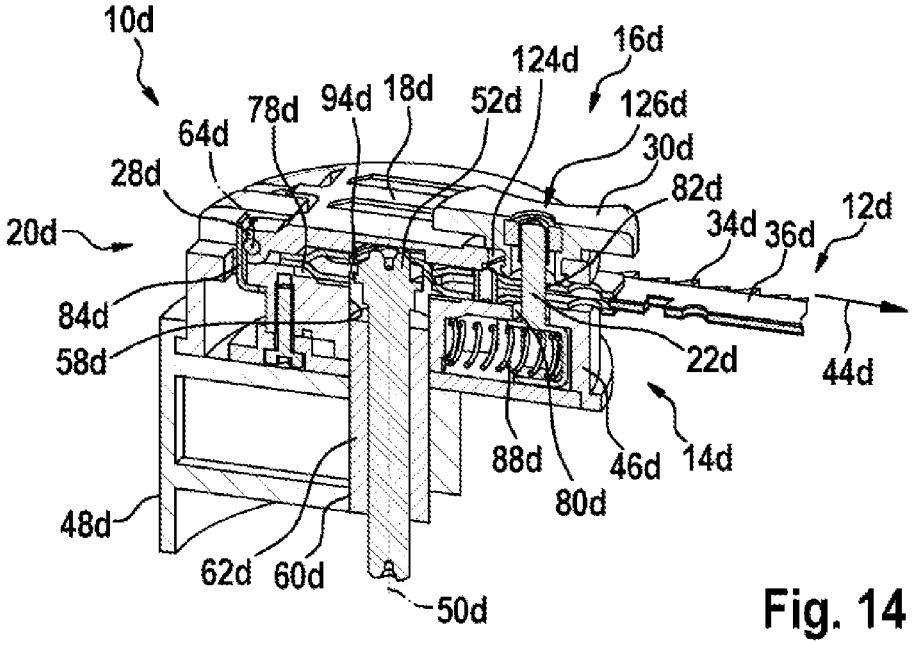

The tool coupling device 10*d* additionally comprises at least one movement coupling unit 20*d*, by means of which the tool holding element 18*d*, for the purpose of moving a tensioning element 22*d* of the cutting-strand tensioning unit 14*d*, can be coupled to the tensioning element 22*d*. The movement coupling unit 20*d* is of a configuration similar to that of the movement coupling unit 20*a* described in FIGS. 1 to 6. Furthermore, the tool holding unit 16*d* has at least one fixing element 30*d*, which is provided to fix the tool holding element 18*d* in at least one position. The fixing element 30*d* in this case is realized as a wing nut. Moreover, the fixing element 30*d* is mounted in a rotationally and translationally movable manner in a fixing recess 124*d* of the tool holding element 18*d* (FIG. 14). For the purpose of fixing the tool holding element 18*d*, the fixing element 30*d* acts in combination with a threaded region 126*d* of the tensioning element 22*d*. When the tool holding element 18*d* is moved into a tool fixing position of the tool holding element 18*d*, the fixing element 30*d* and the threaded region 126*d* of the tensioning element 22*d* are connected to each other. Since the fixing element 30*d* is disposed in the fixing recess 124*d*, the tensioning element 22*d* can move translationally together with the fixing element 30*d*. In respect of further features of the tool coupling device 10*d*, reference may be made to the description of FIGS. 1 to 6.

Figure 15:
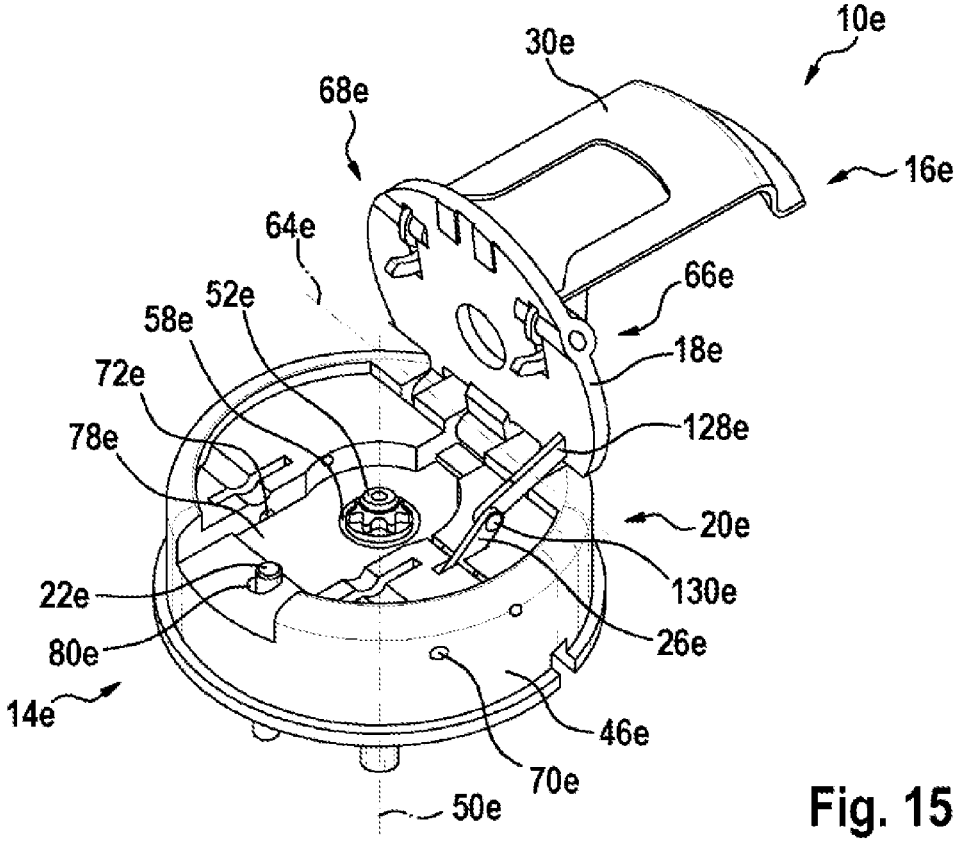
Figure 16:
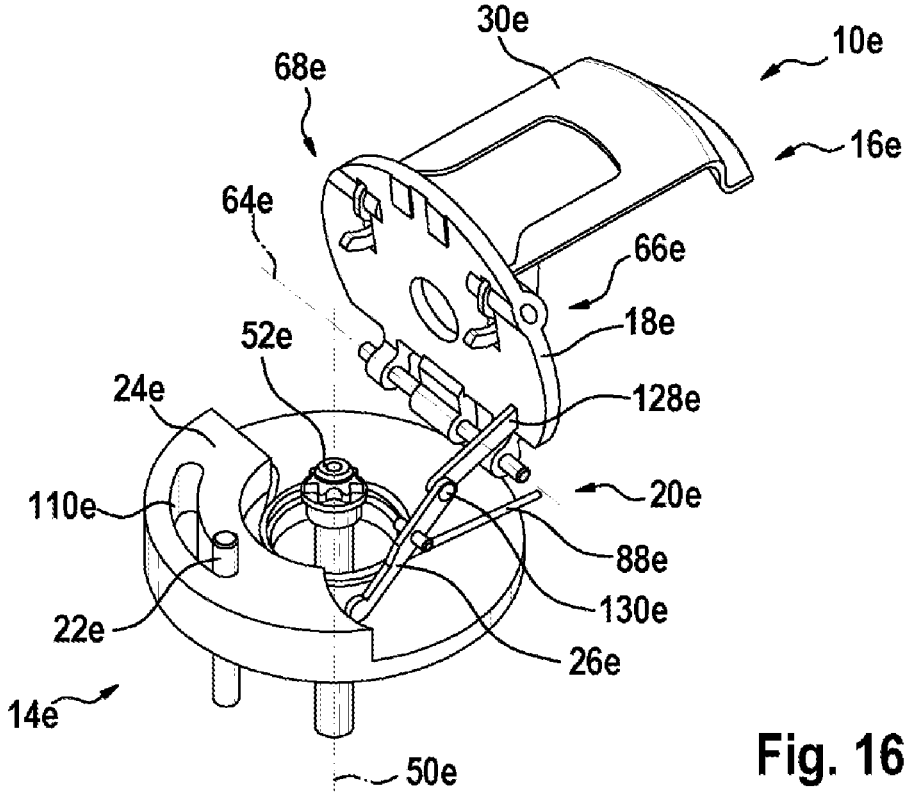

FIG. 15 shows a further, alternative tool coupling device 10*e*, which is provided to receive a power-tool parting device realized as a closed system (not represented in greater detail here), demounted from a portable power tool (not represented in greater detail here). The portable power tool is of a configuration similar to that of the portable power tool 32*a* described in FIGS. 1 to 6. The portable power tool and the power-tool parting device together form a power tool system. The tool coupling device 10*e* comprises at least one cutting-strand tensioning unit 14*e*, for generating a cutting-strand tensioning force, and at least one tool holding unit 16*e*, which has at least one movably mounted tool holding element 18*e*. The tool holding element 18*e* is mounted such that it can be swiveled about an axis of motion 64*e* of the tool holding element 18*e* that is at least substantially parallel to a plane of main extent of the tool holding element 18*e*, or about one that is at least substantially perpendicular to a rotation axis 50*e* of a drive element 52*e* of the tool coupling device 10*e*.

The tool coupling device 10*e* additionally comprises at least one movement coupling unit 20*e*, by means of which the tool holding element 18*e*, for the purpose of moving a tensioning element 22*e* of the cutting-strand tensioning unit 14*e*, can be coupled to the tensioning element. The movement coupling unit 20*e* has at least one gate element 24*e* for moving the tensioning element 22*e* as a result of a movement of the tool holding element 18*e*. The gate element 24*e* is mounted in a rotatable manner. The gate element 24*e* in this case is mounted in a rotatable manner in a main body 46*e* of the tool coupling device 10*e*. The gate element 24*e* additionally has at least one tensioning-element guide gate 110*e* for moving the tensioning element 22*e* as a result of a movement of the tool holding element 18*e*. The movement coupling unit 20*e* additionally comprises at least one lever element 26*e* that, as a result of a movement of the tool holding element 18*e*, moves the gate element 24*e* for the purpose of moving the tensioning element 22*e*. The lever element 26*e* in this case is mounted in the main body 46*e* such that it can be swiveled about an axis of motion of the lever element 26*e*. The axis of motion of the lever element 26*e* in this case is at least substantially parallel to the axis of motion 64*e* of the tool holding element 18*e*. Moreover, the movement coupling unit 20*e* has a force transfer element 128*e*, which is mounted in a swiveling manner on the tool holding element 18*e*. In addition, the force transfer element 128*e* is connected in a swiveling manner to the lever element

26*e*, by means of a link element 130*e*. The link element 130*e* in this case is realized as a hinge pin, which engages in a link eye of the lever element 26*e* and of the force transfer element 128*e*, respectively.

Furthermore, the movement coupling unit 20*e* comprises at least one spring element 88*e*, which is provided to apply a spring force to the gate element 24*e*. The spring element 88*e* is realized as a leg spring. The spring element 88*e* in this case is supported with one end on the main body 46*e* and, with another end, the spring element 88*e* is supported on the gate element 24*e*. As a result of the tool holding element 18*e* moving into a tool fixing position of the tool holding element 18*e*, in the direction of the main body 46*e*, the lever element 26*e* is actuated by means of the force transfer element 128*e*. As a result, the lever element 26*e* releases the gate element 24*e*. The gate element 24*e* is moved by the spring force of the spring element 88*e*. As a result, the tensioning element 22*e* is moved into a tensioning position of the tensioning element 22*e* by means of the tensioning-element guide gate 110*e*. In respect of further features of the tool coupling device 10*e*, reference may be made to the description of FIGS. 1 to 6.

Figure 17:
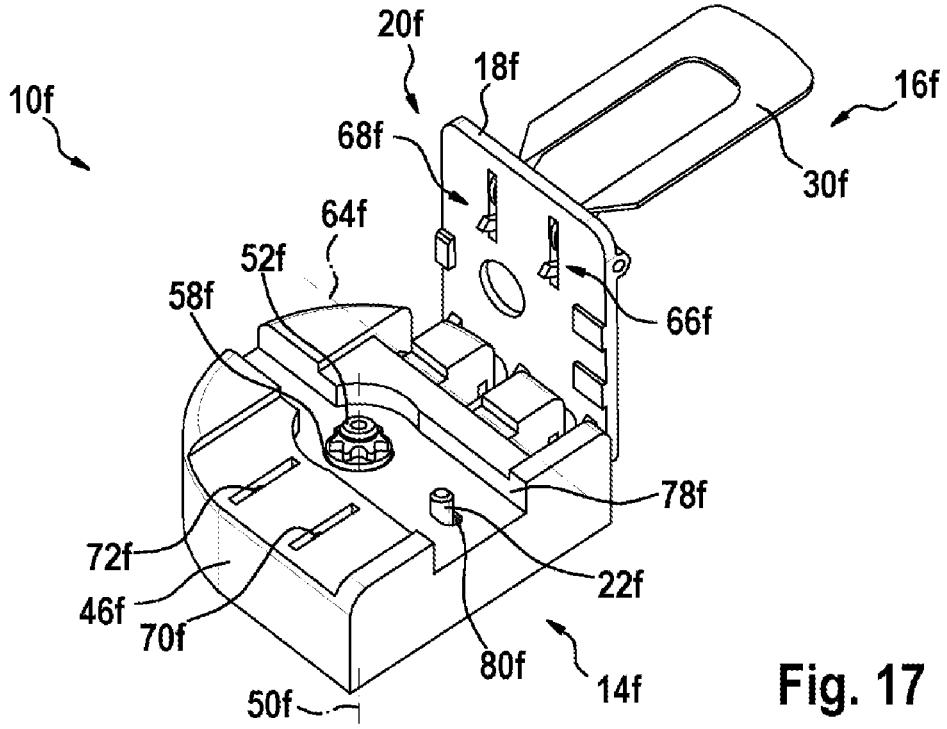

FIG. 17 shows a further, alternative tool coupling device 10*f*, which is provided to receive a power-tool parting device 12*f* realized as a closed system (FIG. 18), demounted from a portable power tool (not represented in greater detail here). The portable power tool is of a configuration similar to that of the portable power tool 32*a* described in FIGS. 1 to 6. The portable power tool and the power-tool parting device 12*f* together form a power tool system. The tool coupling device 10*f* has at least one cutting-strand tensioning unit 14*f*, for generating a cutting-strand tensioning force, and at least one tool holding unit 16*f*, which has at least one movably mounted tool holding element 18*e*. The tool holding element 18*f* is mounted such that it can be swiveled about an axis of motion 64*f* of the tool holding element 18*f* that is at least substantially parallel to a plane of main extent of the tool holding element 18*f*, or about one that is at least substantially perpendicular to a rotation axis 50*f* of a drive element 52*f* of the tool coupling device 10*f*.

Figure 18:
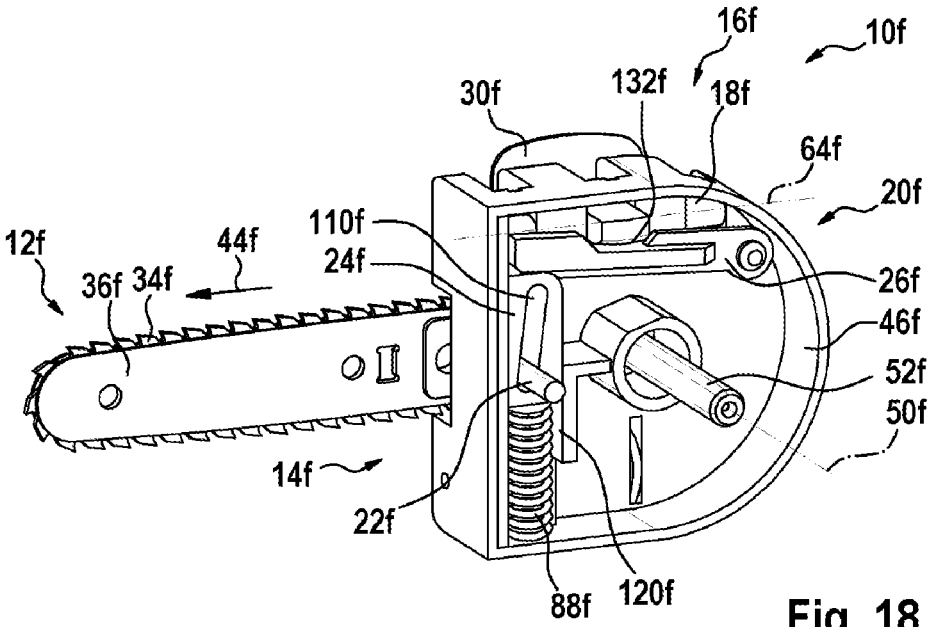

The tool coupling device 10*f* additionally comprises at least one movement coupling unit 20*f*, by means of which the tool holding element 18*f*, for the purpose of moving a tensioning element 22*f* of the cutting-strand tensioning unit 14*f*, can be coupled to the tensioning element 22*f*. The movement coupling unit 20*f* has at least one gate element 24*f* for moving the tensioning element 22*f* as a result of a movement of the tool holding element 18*f*. The gate element 24*f* is mounted in a translationally movable manner. In this case, the gate element 24*f* is guided in an axial bearing recess 120*f* of a main body 46*f* of the tool coupling device 10*f* (FIG. 18). The gate element 24*f* comprises a tensioning-element guide gate 110*f*, for moving the tensioning element 22*f*. The tensioning-element guide gate 110*f* extends at least substantially transversely in relation to an axis of motion of the gate element 24*f*. The tensioning-element guide gate 110*f* is thus sloped relative to the axis of motion of the gate element 24*f*.

The movement coupling unit 20*f* additionally comprises at least one lever element 26*f* that, as a result of a movement of the tool holding element 18*f*, moves the gate element 24*f* for the purpose of moving the tensioning element 22*f*. The lever element 26*f* is mounted in the main body 46*f* so as to be rotatable about an axis of motion of the lever element 26*f* that is at least substantially parallel to the rotation axis 50*f* of the drive element 52*f*. For the purpose of moving the gate element 24*f*, the lever element 26*f* bears with one end against the gate element 24*f*. In addition, the lever element 26*f* has a pressure region 132*f*, which acts in combination with the tool holding element 18*f*. Furthermore, the movement coupling unit 20*f* comprises at least one spring element 88*f*, which is provided to apply a spring force to the gate element 24*f* of the movement coupling unit 20*f*. The spring element 88*f* is realized as a helical compression spring. The spring element 88*f* in this case is supported with one end on the main body 46*f* and, with another end, the spring element 88*f* is supported on the gate element 24*f*. The spring element 88*f* is disposed in the axial bearing recess 120*f* of the main body 46*f*. In respect of further features of the tool coupling device 10*f*, reference may be made to the description of FIGS. 1 to 6.

Figure 19:
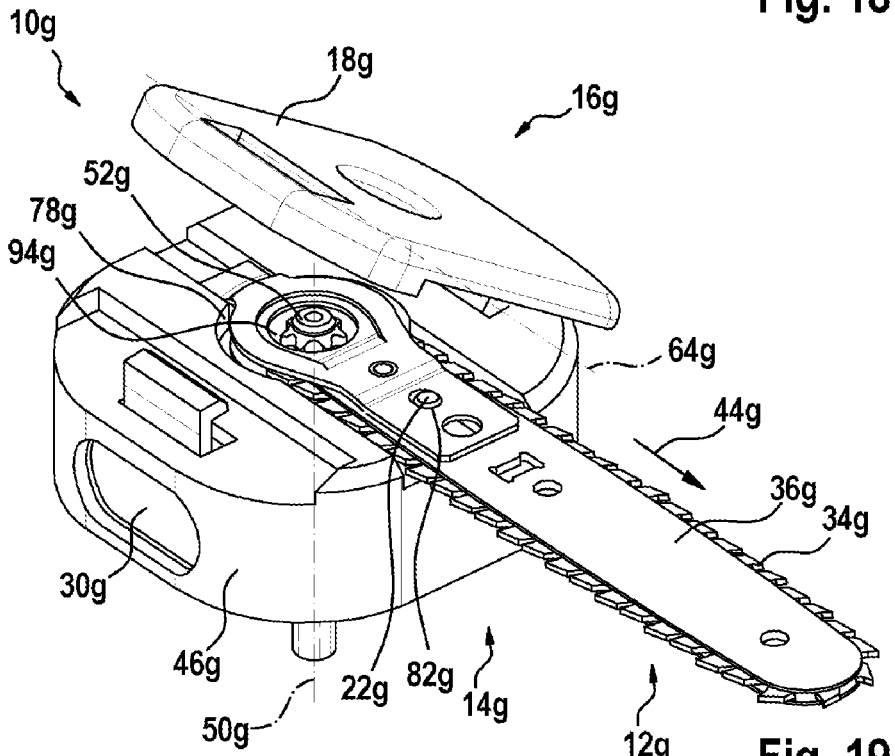
Figure 20:
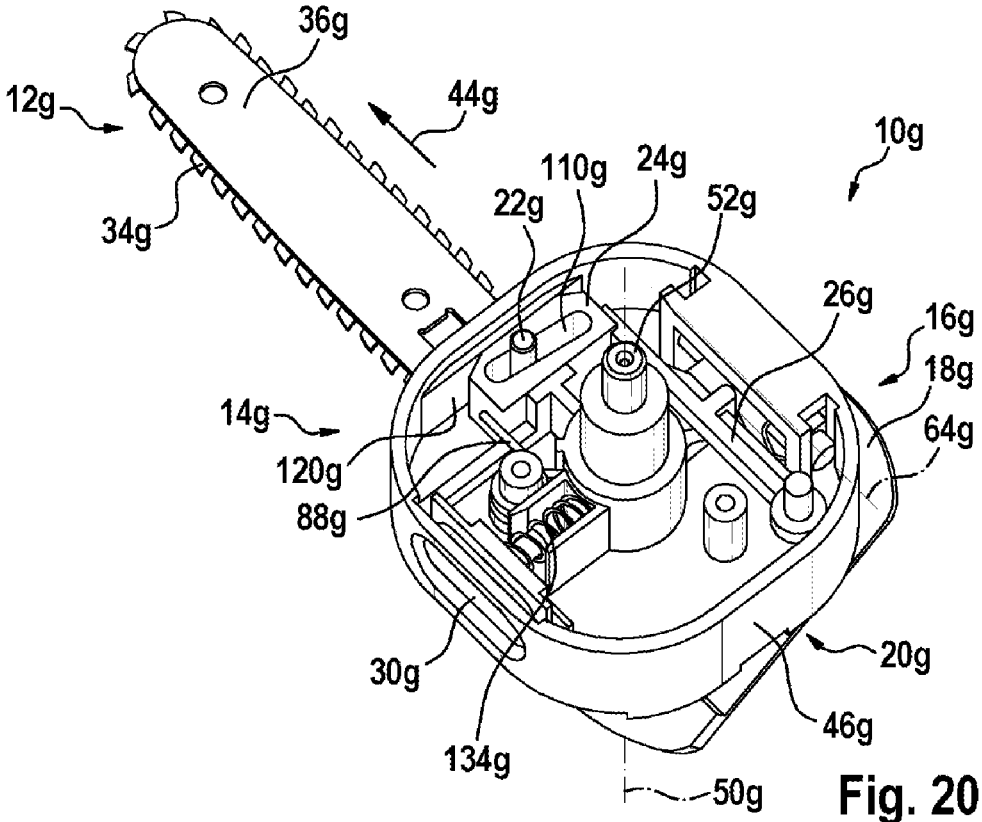
Figure 21:
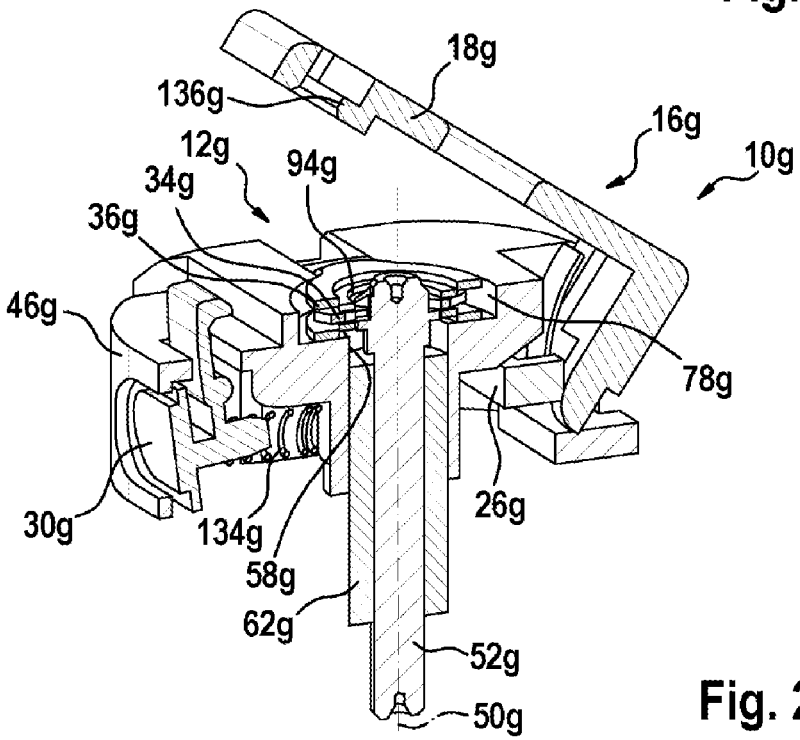

FIG. 19 shows a further, alternative tool coupling device 10*g*, which is provided to receive a power-tool parting device 12*g* realized as a closed system, demounted from a portable power tool (not represented in greater detail here). The portable power tool is of a configuration similar to that of the portable power tool 32*a* described in FIGS. 1 to 6. The portable power tool and the power-tool parting device 12*g* together form a power tool system. The configuration of the tool coupling device 10*g* is at least substantially similar to that of the tool coupling device 10*f* described in FIGS. 17 and 18. Unlike the tool coupling device 10*f*, a movement coupling unit 20*g* of the tool coupling device 10*g* has a spring element 88*g* realized as a leg spring. In addition, a tool holding unit 16*g* of the tool coupling device 10*g* has at least one fixing element 30*g* provided to fix a tool holding element 18*g* in at least one position. The fixing element 30*g* is mounted in a swiveling manner in a main body 46*g* of the tool coupling device 10*g* (FIG. 21). The tool holding unit 16*g* additionally has a fixing spring element 134*g*, which is provided to apply a spring force to the fixing element 30*g* (FIGS. 20 and 21). The fixing element 30*g* is thus realized as a spring-biased latching hook, which acts in combination with a fixing extension 136*g* disposed in the tool holding element 18*g*, for the purpose of fixing the tool holding element 18*g* in a tool fixing position (FIG. 21). The fixing extension 136*g* in this case is realized so as to be integral with the tool holding element 18*g*.

The invention claimed is:

1. A tool coupling device for receiving a power-tool parting device, the tool coupling device comprising:

a main body;

at least one cutting-strand tensioning unit supported by the main body and configured to generate a cutting-strand tensioning force;

at least one tool holding unit operatively connected to the at least one cutting-strand tensioning unit and including at least one movably mounted tool holding element having an operating element that is rotatable about an axis of rotation to a first position and a second position; and at least one movement coupling unit configured to couple the at least one movably mounted tool holding element to a tensioning element of the at least one cutting-strand tensioning unit to move translationally the tensioning element relative to the main body, the at least one movement coupling unit including at least one gate element defining a guide gate through which the tensioning element extends, the guide gate operatively connected to the operating element for coaxial rotation about the axis of rotation with the operating element, the guide gate defining a spiral course in which a first end of the guide gate is located a first distance from the axis of rotation and a second end of the guide gate is located a second distance from the axis of rotation, wherein the first distance is less than the second distance, wherein the at least one cutting-strand tensioning unit is configured to apply the cutting-strand tensioning force to the power-tool parting device when the operating element is rotated to position the tensioning element at the second end of the guide gate, and wherein the at least one cutting-strand tensioning unit is configured to release the cutting-strand tensioning force when the operating element is rotated to position the tensioning element at the first end of the guide gate.

2. A portable power tool, comprising:

a tool coupling device configured to receive a power-tool parting device, the tool coupling device including:

a main body;

at least one cutting-strand tensioning unit supported by the main body and configured to generate a cutting-strand tensioning force;

at least one tool holding unit operatively connected to the at least one cutting-strand tensioning unit and including at least one movably mounted tool holding element having an operating element that is rotatable about an axis of rotation to a first position and a second position; and at least one movement coupling unit configured to couple the at least one movably mounted tool holding element to a tensioning element of the at least one cutting-strand tensioning unit to move translationally the tensioning element relative to the main body, the at least one movement coupling unit including at least one gate element defining a guide gate through which the tensioning element extends, the guide gate operatively connected to the operating element for coaxial rotation about the axis of rotation with the operating element, the guide gate defining a spiral course in which a first end of the guide gate is located a first distance from the axis of rotation and a second end of the guide gate is located a second distance from the axis of rotation, wherein the first distance is less than the second distance, wherein the at least one cutting-strand tensioning unit is configured to apply the cutting-strand tensioning force to the power-tool parting device when the operating element is rotated to position the tensioning element at the second end of the guide gate, and wherein the at least one cutting-strand tensioning unit is configured to release the cutting-strand tensioning force when the operating element is rotated to position the tensioning element at the first end of the guide gate.

3. A power tool system, comprising:

at least one portable power tool, including:

a main body;

at least one cutting-strand tensioning unit supported by the main body and configured to generate a cutting-strand tensioning force;

at least one tool holding unit operatively connected to the at least one cutting-strand tensioning unit and including at least one movably mounted tool holding element having an operating element that is rotatable about an axis of rotation to a first position and a second position; and at least one movement coupling unit configured to couple the at least one movably mounted tool holding element to a tensioning element of the at least one cutting-strand tensioning unit to move translationally the tensioning element relative to the main body, the at least one movement coupling unit including at least one gate element defining a guide gate through which the tensioning element extends, the guide gate operatively connected to the operating element for coaxial rotation about the axis of rotation with the operating element, the guide gate defining a spiral course in which a first end of the guide gate is located a first distance from the axis of rotation and a second end of the guide gate is located a second distance from the axis of rotation; and at least one power-tool parting device, including at least one cutting strand and at least one guide unit that, together with the at least one cutting strand, forms a closed system, wherein the first distance is less than the second distance, wherein the at least one cutting-strand tensioning unit is configured to apply the cutting-strand tensioning force to the power-tool parting device when the operating element is rotated to position the tensioning element at the second end of the guide gate, and wherein the at least one cutting-strand tensioning unit is configured to release the cutting-strand tensioning force when the operating element is rotated to position the tensioning element at the first end of the guide gate.

* * * * *